United States Patent [19]

Wolf

[11] Patent Number: 4,883,114

[45] Date of Patent: Nov. 28, 1989

[54] OSCILLATION METHOD AND APPARATUS FOR A CONTINUOUS CASTING MOLD

[75] Inventor: Manfred Wolf, Zurich, Switzerland

[73] Assignees: Clecim, Cergy-Pontoise, France; Davy (Distington) Limited, Cumbria, England; Sumitomo Heavy Industries Ltd., Tokyo, Japan

[21] Appl. No.: 301,605

[22] Filed: Jan. 24, 1989

[30] Foreign Application Priority Data

Jan. 28, 1988 [CH] Switzerland ..... 00305/88

[51] Int. Cl.[4] ..... B22D 11/04; B22D 11/16

[52] U.S. Cl. ..... 164/478; 164/154; 164/416; 164/452

[58] Field of Search ..... 164/478, 416, 452, 154

[56] References Cited

FOREIGN PATENT DOCUMENTS

| | | | |
|---|---|---|---|
| 2002366 | 1/1971 | Fed. Rep. of Germany . | |
| 57-115948 | 7/1982 | Japan | 164/452 |
| 60-6248 | 1/1985 | Japan | 164/478 |
| 60-87955 | 5/1985 | Japan | 164/478 |
| 61-20653 | 1/1986 | Japan | 164/452 |
| 61-23559 | 2/1986 | Japan | 164/452 |

OTHER PUBLICATIONS

Abstract of Japanese Patent Publication, 61-162256, Published Jul. 22, 1986.

*Primary Examiner*—Richard K. Seidel
*Assistant Examiner*—J. Reed Batten, Jr.
*Attorney, Agent, or Firm*—Peter K. Kontler; Tobias Lewenstein

[57] ABSTRACT

Steel is teemed into one end of a continuous casting mold to form a continuously cast strand which is withdrawn through the other end of the mold. The mold is oscillated and the strand is accelerated through a first range of speeds less than 1.2 meter per minute and a second range of speeds greater than this value. As the strand accelerates through the first range, the oscillation frequency is increased from a value between 60 and 120 cycles per minute to a value between 120 and 200 cycles per minute while holding the stroke constant. On the other hand, when the strand accelerates through the second range, the oscillation frequency is maintained constant and the stroke is increased with strand speed. A condition of negative strip is maintained in both ranges and the time for which negative strip occurs during each oscillation cycle approximates 0.1 second.

20 Claims, 2 Drawing Sheets

OSCILLATION METHOD AND APPARATUS FOR A CONTINUOUS CASTING MOLD

BACKGROUND OF THE INVENTION

The invention relates generally to continuous casting. More particularly, the invention relates to a method of and an apparatus for oscillating the mold in a continuous casting installation, especially an installation for the continuous casting of steel.

During continuous casting, and particularly the continuous casting of steel, the continuous casting mold is oscillated in order to introduce lubricant between the mold wall and the shell of the continuously cast strand. The purpose is to prevent or reduce sticking of the shell to the mold wall.

Various oscillation mechanisms and methods have been proposed for the continuous casting of steel. Mechanical oscillation drives which generate a sinusoidal motion are in widespread use. The sinusoidal oscillatory motion has proven to be satisfactory at low and medium casting speeds, i.e., strand speeds.

From the West German Auslegeschrift No. 2 002 366 it is known to adjust the sinusoidal oscillatory motion for high casting speeds by increasing the stroke in proportion to the strand withdrawal speed. In other publications, it is also proposed to increase the frequency in dependence upon the strand withdrawal speed. If the characteristics of the relative motion between a moving strand shell and a sinusoidally oscillating mold are proportionally carried over to high strand withdrawal speeds, e.g., speeds between 2 and 6 meters per minute, a correspondingly large stroke or high frequency, or an increase in both stroke and frequency, must be achieved. Satisfactory results cannot be obtained with this type of oscillation, particularly for steel grades such as the so-called sticking grades which are difficult to cast.

Oscillatory motions other than the sinusoidal oscillatory motion are also known, for example, from the Japanese published specification No. 61-162 256. As a rule, the time periods for the upward and downward strokes in these non-sinusoidal oscillatory motions are unequal, e.g., the time periods are in a ratio of 1:3. On a plot of displacement versus time, such oscillations are represented by a sawtooth-shaped line. The mold can be driven by an hydraulic or equivalent drive unit. Oscillation drives which generate a non-sinusoidal motion are easy to regulate as regards stroke and frequency. Nevertheless, the quality of the strand surface, particularly for steel grades designated as sticking grades, is unsatisfactory because of oscillation marks and the occurrence of breakouts in the mold at high casting speeds.

OBJECTS AND SUMMARY OF THE INVENTION

It is an object of the invention to provide a mold oscillation method for continuous casting, especially for the continuous casting of steel, which allows the surface quality of a strand to be improved.

Another object of the invention is to provide a mold oscillation method for continuous casting, particularly for the continuous casting of steel, which makes it possible to achieve relatively large variations in strand withdrawal speed, both at the beginning of a casting process and during such process, with an accompanying reduction in surface defects.

An additional object of the invention is to provide a mold oscillation method for continuous casting, especially for the continuous casting of steel, which enables the casting speed to be adjusted to the casting cycle while surface quality is improved and breakouts are reduced even for sticking grades.

A further object of the invention is to provide a mold oscillation method for continuous casting, particularly for the continuous casting of steel, which allows higher casting speeds than heretofore to be obtained, e.g. 2 to 6 meters per minute for thicker slabs and 4 to 10 meters per minute for thinner slabs and billets.

It is also an object of the invention to provide a mold oscillation arrangement for continuous casting, especially for the continuous casting of steel, which enables the surface quality of a strand to be improved.

Still another object of the invention is to provide a mold oscillation arrangement for continuous casting, particularly for the continuous casting of steel, which makes it possible to achieve relatively large variations in strand withdrawal speed, both at the beginning of a casting process and during such process, with an accompanying reduction in surface defects.

An additional object of the invention is to provide a mold oscillation arrangement for continuous casting, especially for the continuous casting of steel, which enables the casting speed to be adjusted to the casting cycle while surface quality is improved and breakouts are reduced even for sticking grades.

A concomitant object of the invention is to provide a mold oscillation arrangement for continuous casting, particularly for the continuous casting of steel, which allows higher casting speeds than heretofore to be obtained, e.g., 2 to 6 meters per minute for thicker slabs and 4 to 10 meters per minute for thinner slabs and billets.

The preceding objects, as well as others which will become apparent as the description proceeds are achieved by the invention.

One aspect of the invention resides in a continuous casting method, e.g., a method of continuously casting steel. The method involves forming a continuously cast strand in a continuous casting mold which defines a casting passage having an inlet end and an outlet end. The forming step includes admitting molten material, e.g., molten steel, into the inlet end and at least partially solidifying the molten material in the mold. The strand is withdrawn from the casting passage via the outlet end in a first direction and the mold is oscillated by alternately moving the latter in the first direction and in a second direction counter to the first direction. Oscillation of the mold is regulated in such a manner that the oscillation frequency increases as the strand accelerates in a first range of speeds to a predetermined speed equal to or less than about 1.2 meter per minute and, preferably, in a first range of speeds extending from standstill to a predetermined speed between about 0.8 and about 1.2 meter per minute. Oscillation of the mold is further regulated such that the oscillation frequency remains substantially constant while the oscillation stroke increases with strand speed as the strand accelerates from the predetermined speed in a second range of speeds.

The oscillating step is advantageously performed in such a manner that displacement of the mold varies cyclically with time in a sawtooth-like fashion. It is also of advantage to regulate mold oscillation so that, during an oscillation cycle, the speed of the mold exceeds the speed of the strand essentially throughout travel of the mold in the first direction and the travel time of the mold in the first direction approximates 0.1 second. This applies to both the first and second speed ranges.

Preferably, the oscillation frequency increases from a value between about 60 and about 120 cycles per minute to a value between about 120 and about 200 cycles per minute as the strand accelerates in the first speed range.

Another aspect of the invention resides in a continuous casting apparatus, e.g., an apparatus for the continuous casting of steel. The apparatus comprises a continuous casting mold such as, for instance, a mold designed for the continuous casting of steel, and the mold defines a casting passage having an inlet end for molten material, e.g., molten steel, and an outlet end for a continuously cast strand of the material. The outlet end is spaced from the inlet end in a first direction. The apparatus is further equipped with a mechanism for oscillating the mold so that the latter alternately moves in the first direction and in a second direction counter to the first direction. Means is provided to regulate the oscillation mechanism and includes computer means programmed to effect oscillation of the mold in such a manner that the oscillation frequency increases as the strand accelerates in a first range of speeds to a predetermined speed equal to or less than about 1.2 meter per minute. It is preferred for the computer means to increase the oscillation frequency from a value between about 60 and about 120 cycles per minute to a value between about 120 and about 200 cycles per minute as the strand accelerates in a first range of speeds extending from standstill to a predetermined speed between about 0.8 and about 1.2 meter per minute. The computer means is further programmed to maintain the oscillation frequency substantially constant while increasing the oscillation stroke with strand speed as the strand accelerates from the predetermined speed in a second range of speeds.

Advantageously, the oscillation mechanism causes displacement of the mold to vary in a sawtooth-like fashion with time. It is also of advantage to program the computer means so that, during an oscillation cycle, the speed of the mold exceeds the speed of the strand essentially throughout travel of the mold in the first direction and the travel time of the mold in such direction approximates 0.1 second. This is applicable to the first speed range as well as the second speed range.

The regulating means may additionally include a comparator for continuously comparing the friction between the strand and the mold with a reference value and continuously transmitting a signal indicative of the difference to the computer means. The computer means may then be operative to vary oscillation of the mold in response to the signal so as to minimize friction between the strand and the mold.

The oscillation method and oscillation arrangement in accordance with the invention make it possible to obtain an improved strand surface during continuous casting. This is particularly true when the strand withdrawal speed must be varied on processing grounds or in connection with predetermined production cycle times for the production of steel. The formation of oscillation marks is reduced. Steel grades designated as sticking grades exhibit a lesser tendency to tear in the oscillation marks when the method and arrangement of the invention are used in combination with appropriate lubricants. Incipient breakouts, i.e., bleedings, within the mold, as well as breakouts outside of the mold, can thereby be reduced. The strand withdrawal speed, which is also known as the casting speed, can be increased well above the conventional range by means of the method and arrangement according to the invention.

The oscillation frequency in the first speed range can be increased stepwise or in some other manner with increasing strand withdrawal speed. In accordance with one embodiment of the method, the oscillation frequency in the first range can be increased proportionally to strand speed from a value between about 60 and about 120 cycles per minute at the start or standstill to a value between about 120 and 200 cycles per minute when the strand has accelerated through the first range. The increase in oscillation frequency may obey the relationship $f=K\cdot V_c^n$ where f is the oscillation frequency, K is a constant having a value between about 100 and about 200 cycles per minute, $V_c$ is the speed of the strand and n is a number smaller than about 0.5. The oscillation frequency in the first speed range may be increased while the stroke is maintained substantially constant.

A significant feature of the non-sinusoidal oscillation preferably employed in accordance with the invention is the large variation which can be achieved in the backward and forward speeds of the mold within an oscillation cycle or within a specified stroke. According to another embodiment of the method, it is proposed to increase the oscillation frequency in the first speed range while maintaining the stroke substantially constant at a value between about 2 and about 5 mm and to increase the stroke proportionally to strand withdrawal speed in the second speed range such that the stroke remains within the limits of about 2 and about 12 mm.

It is further proposed to maintain a negative strip time, $t_n$, of about $0.1t_c$ to about $0.2t_c$ in the first speed range where $t_c$ is the duration of an oscillation cycle. Negative strip is that condition in which the speed of the mold exceeds the speed of the strand when the mold moves in the same direction as the strand.

In accordance with an additional embodiment of the invention, the following relationship is satisfied in the second speed range while the oscillation frequency is held essentially constant:

$$\frac{\text{mold speed in first direction}}{\text{strand withdrawal speed}} = \frac{V_n}{V_c} = 1.02 \text{ to } 1.10$$

The negative strip time, $t_n$, in the second speed range may be maintained between about $0.2t_c$ and $0.33t_c$ where $t_c$ is again the duration of an oscillation cycle.

The novel features which are considered as characteristic of the invention are set forth in particular in the appended claims. The improved oscillation method, as well as the construction and mode of operation of the improved oscillation arrangement, will, however, be best understood upon perusal of the following detailed description of certain specific embodiments when read in conjunction with the accompanying drawings.

DESCRIPTION OF THE PREFERRED EMBODIMENTS

Figure 1:
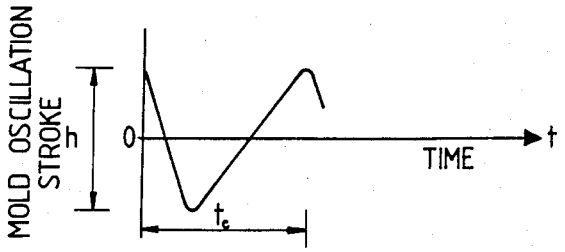
FIG. 1 is a plot of mold oscillation stroke versus time illustrating a sawtooth-shaped oscillatory motion.

Referring to FIG. 1, this illustrates a plot of stroke, h, versus time, t, for a continuous casting mold which is oscillated in accordance with the invention. The line representing the displacement or motion of the mold is sawtooth-shaped and the duration of an oscillation cycle, that is, one forward and one backward stroke of the mold, is denoted by $t_c$.

Figure 2:
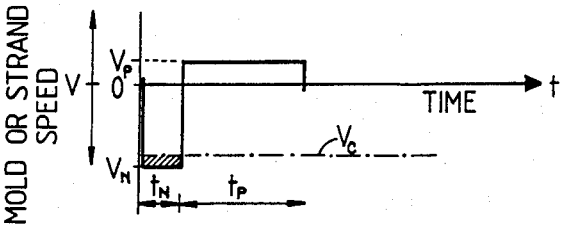
FIG. 2 is a plot of mold speed versus time for the oscillatory motion of FIG. 1.

FIG. 2 is a plot of speed or velocity, V, versus time, t, for a continuous casting mold oscillated according to the sawtooth-like pattern of FIG. 1. In FIG. 2, the scale of the time axis, t, is identical to that of FIG. 1. The solid line in FIG. 2 represents the speed or velocity of the mold whereas the dash-and-dot line denotes strand withdrawal speed, $V_c$, which is the speed or velocity at which a continuously cast strand formed in the mold is withdrawn from the latter. The strand withdrawal speed is also known as the casting speed.

During an oscillation cycle, the mold moves in the same direction as the strand for a time interval $t_n$ and the speed, $V_n$, of the mold exceeds the speed of the strand essentially throughout the time interval $t_n$. In other words, the speed of the mold exceeds the speed of the strand essentially throughout travel of the mold in the direction of movement of the strand. The condition in which the mold moves in the same direction as, and at a greater speed than, the strand is known as negative strip and the time interval $t_n$ is accordingly here denoted as the negative strip time interval.

During an oscillation cycle, the mold also moves counter to the direction of travel of the strand. The time interval which corresponds to movement of the mold in a direction opposite to the direction of travel of the strand is designated $t_p$ and the speed or velocity of the mold during travel counter to the strand is designated $V_p$.

The hardening outer shell or skin of the strand is subjected to compression during the negative strip time interval $t_n$ and to tension during the time interval $t_p$. The sum of $t_n$ and $t_p$ equals the duration, $t_c$, of an oscillation cycle.

Figure 3:
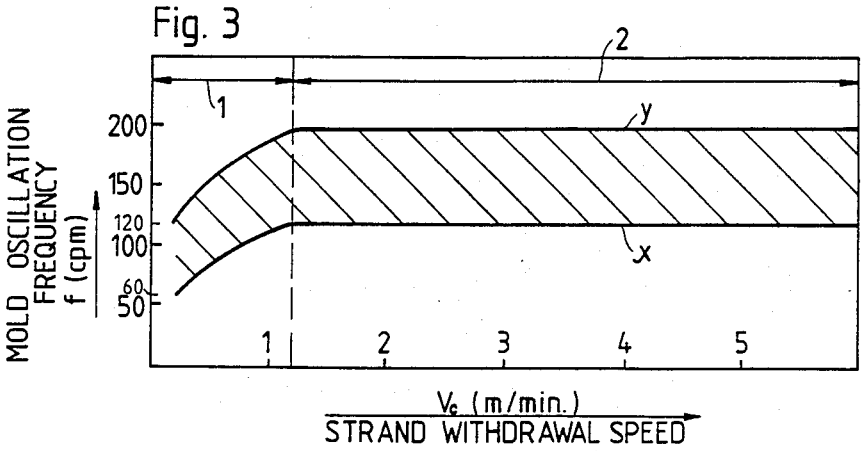
FIG. 3 is a plot of mold oscillation frequency as a function of strand withdrawal speed.

FIG. 3 is a plot of mold oscillation frequency, f, in cycles per minute (cpm) as a function of strand withdrawal speed, $V_c$, in meters per minute (m/min.). The hatched band represents the frequencies in accordance with the invention for different grades of steel.

The hatched band of FIG. 3 is bounded on one side by a first boundary line x. The boundary line x represents the mold oscillation frequencies for steel grades having a strong sticking tendency or, expressed differently, steel grades which form a strand having a weak outer skin or shell in the region of the surface of the molten steel bath in the mold. These steel grades are designated "sticking grades".

The hatched band of FIG. 3 is further bounded by a second boundary line y. The boundary line y represents mold oscillation frequencies for steel grades which are highly susceptible to the formation of depressions and oscillation marks. In other words, the boundary line y represents mold oscillation frequencies for steel grades which form a strand having a strong outer skin or shell in the region of the surface of the molten steel bath in the mold so that the strand tends to develop deep oscillation marks and depressions.

The double-headed arrow 1 in FIG. 3 denotes a first range of strand withdrawal speeds extending from standstill to a value no greater than about 1.2 meter per minute. Preferably, the upper end of the first speed range is between about 0.8 and 1.2 meter per minute. A second range of strand withdrawal speeds is indicated by the double-headed arrow 2. The second range extends from the end of the first range, e.g., from a strand speed between about 0.8 and 1.2 meter per minute, in the direction of increasing strand speeds.

When a strand consisting of a steel from the group of sticking grades is accelerated in the first speed range 1 from 0.1 to approximately 1.2 meter per minute, the mold oscillation frequency is increased along the boundary line x from about 60 to about 120 cpm. As the strand accelerates in the second speed range 2, the mold oscillation frequency is maintained essentially constant at approximately 120 cpm.

Figure 4:
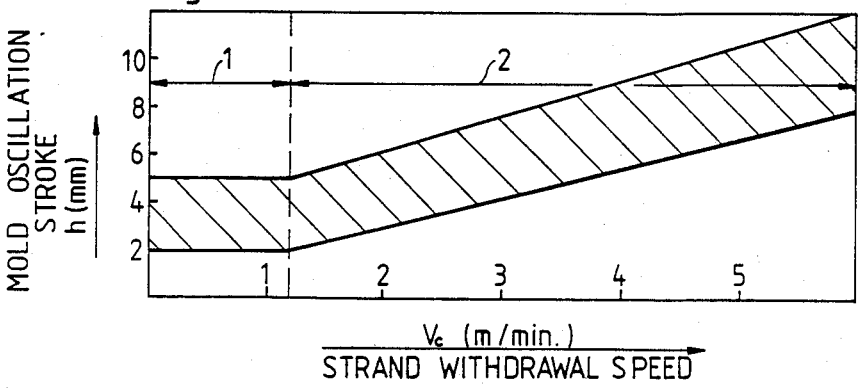
FIG. 4 is a plot of mold oscillation stroke as a function of strand withdrawal speed.

FIG. 4 is a plot of mold oscillation stroke, h, in millimeters (mm) versus strand withdrawal speed, $V_c$, in meters per minute (m/min.). The hatched band represents the spectrum of mold oscillation strokes according to the invention for various grades of steel.

As illustrated in FIG. 4, the mold oscillation stroke increases with strand withdrawal speed in the second speed range 2. For a strand which is composed of a steel from the group of sticking grades and is accelerated per the boundary line x of FIG. 3, the mold oscillation stroke is increased with strand withdrawal speed in the second speed range 2 while maintaining the stroke between about 2 and about 12 mm and, preferably, between about 4 and about 10 mm.

When a strand consisting of a steel grade exhibiting a pronounced tendency to develop oscillation marks is accelerated in the first speed range 1 from 0.1 to approximately 1.2 meter per minute, the mold oscillation frequency is increased along the boundary line y of FIG. 3 from about 120 to about 200 cpm. In the second speed range 2, the mold oscillation frequency is held essentially constant at approximately 200 cpm as the strand accelerates. However, per FIG. 4, the mold oscillation stroke increases with strand withdrawal speed in the second speed range 2. For a strand which is composed of a steel grade with a pronounced tendency for the development of oscillation marks and which is accelerated in accordance with the boundary line y of FIG. 3, the mold oscillation stroke is increased with strand withdrawal speed in the second speed range 2 while maintaining the mold oscillation stroke between about 2 and about 10 mm and, preferably, between about 2 and about 8 mm.

The mold oscillation stroke may, for example, be increased proportionally to strand withdrawal speed in the second speed range 2. In the first speed range 1, the mold oscillation stroke may be maintained substantially constant as strand withdrawal speed increases. Advantageously, the mold oscillation stroke is held essentially constant at a value between about 2 and about 5 mm in the first speed range 1 as indicated in FIG. 4.

From the preceding description, it follows that the mold oscillation frequency increases from a value between about 60 and about 120 cpm to a value between about 120 and about 200 cpm as the strand accelerates in the first speed range 1. In contrast, the mold oscillation stroke may be maintained substantially constant in such speed range. On the other hand, the mold oscillation frequency is held essentially constant as the strand accelerates in the second speed range 2 while the mold oscillation stroke increases with strand withdrawal speed. The mold oscillation stroke may increase proportionally to strand withdrawal speed in the second speed range 2 and is preferably maintained between about 2 and about 12 mm in this speed range.

The mold oscillation frequency may be increased in proportion to strand withdrawal speed within the first speed range 1. This is advantageously accomplished according to the following equation:

$$f=K\cdot V_c^n \quad (1)$$

Here, f is the mold oscillation frequency in cpm, K is a constant having a value between about 100 and 200 cpm, $V_c$ is the strand withdrawal speed in meters per minute and n is a number smaller than about 0.5.

The negative strip time interval, $t_n$, may be set per the following relation in the first speed range 1:

$$t_n=0.1t_c \text{ to } 0.2t_c \quad (2)$$

where $t_c$ is the duration of an oscillation cycle. It is preferred for the negative strip time interval to be of the order of 0.1 second in the first speed range 1.

In the second speed range 2, the negative strip time interval, $t_n$, may be selected in accordance with the following criterion:

$$t_n=0.2t_c \text{ to } 0.33t_c \quad (3)$$

Preferably, the negative strip time interval has an order of magnitude of 0.1 second in the second speed range 2 also.

It is of advantage for the speed, $V_n$, of the mold during movement in the direction of travel of the strand to have the following relationship to the withdrawal speed, $V_c$, of the strand in the second speed range 2:

$$V_n/V_c=1.02 \text{ to } 1.10 \quad (4)$$

Figure 5:
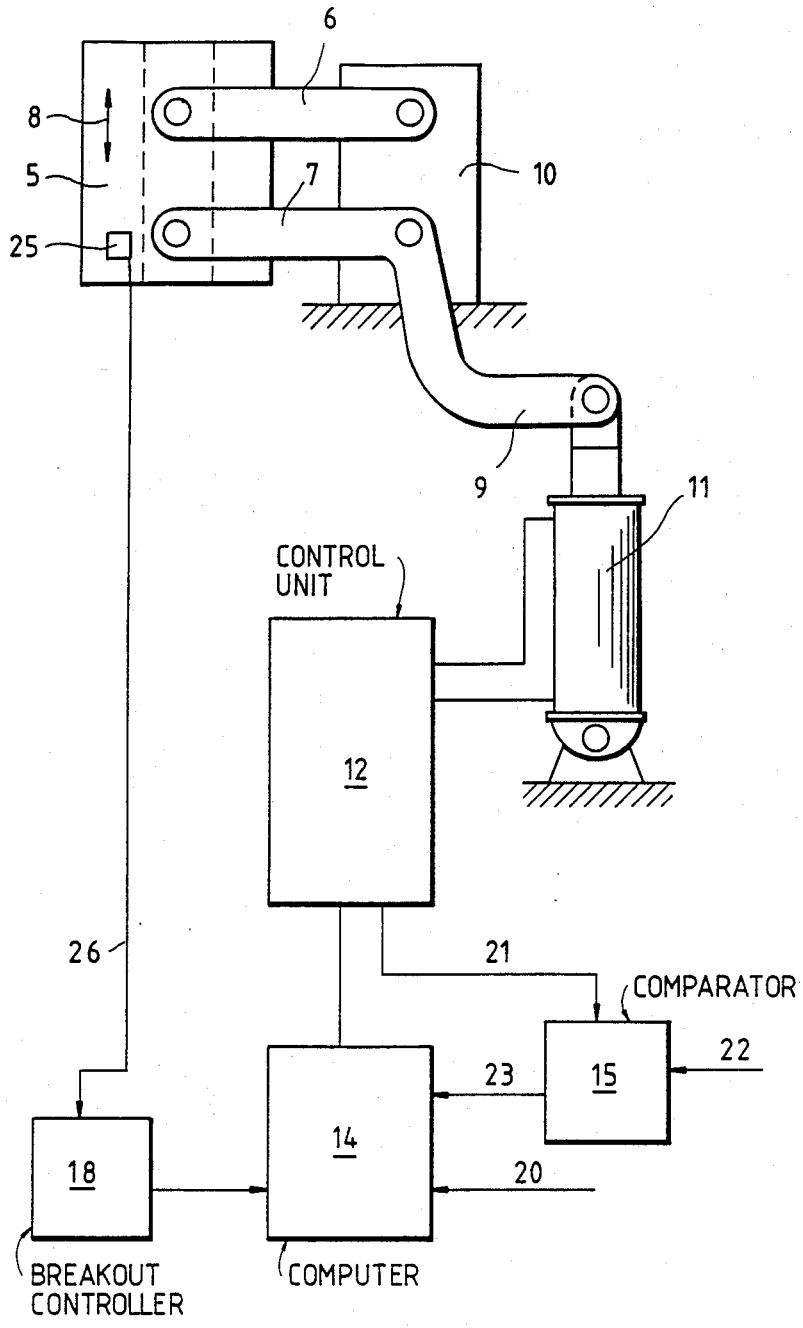
FIG. 5 schematically illustrates a continuous casting apparatus equipped with a mold oscillation arrangement according to the invention.

FIG. 5 illustrates a continuous casting apparatus having a mold oscillation arrangement in accordance with the invention. Only those elements of the continuous casting apparatus necessary for an understanding of the invention are shown in FIG. 5.

The apparatus of FIG. 5 is assumed to be designed for the continuous casting of steel and includes a continuous casting mold 5 which is capable of accommodating a bath of molten steel and cooling the same so as to cause solidification of at least that part of the bath adjacent to the mold walls. The mold 5 defines a casting passage indicated by broken lines and the casting passage has an inlet end for molten steel and an outlet end for a continuously cast strand formed by at least partial solidification of the steel in the mold 5. The apparatus is further assumed to be of the type in which the mold is oriented such that the casting passage extends generally vertically and the upper end of the casting passage constitutes the inlet end whereas the lower end of the casting passage constitutes the outlet end.

In operation, a stream of molten steel is continuously teemed into the upper end of the casting passage so that a bath of molten steel forms therein. The molten steel adjacent to the walls of the mold 5 solidifies to form a skin or shell which surrounds a core of molten steel. The shell and its core together constitute a continuously cast steel strand which is continuously withdrawn from the mold 5 via the lower end of the casting passage. Withdrawal of the strand is accomplished by means of a conventional withdrawal device which has not been illustrated in order to preserve clarity. The strand travels in a downward direction as it leaves the casting passage and it will be observed that the outlet end of the casting passage is spaced from the inlet end thereof in this direction.

As the strand is accelerated by the withdrawal device, the mold 5 is oscillated in the manner described above. To this end, the mold 5 is mounted on two short levers 6 and 7 extending towards the mold 5 from an elevated foundation or suitable steel support structure 10. The short lever 7 has an extension 9 which is connected to a schematically illustrated, hydraulic oscillation drive 11. The levers 6 and 7, the extension 9 and the drive 11 all constitute part of an oscillation mechanism for the mold 5.

The movements of the mold 5 as it oscillates are indicated by a double-headed arrow 8. This shows that the mold 5 alternately moves downwards and upwards, that is, the mold 5 alternately moves in the direction of travel of the strand and counter to the direction of travel of the strand. The oscillation mechanism causes the displacement of the mold 5 during oscillation to vary in a sawtooth-like fashion with time, i.e., in a manner as illustrated in FIG. 1.

The mold oscillation drive 11 is under the control of a regulating device which includes a control unit 12 operatively connected to the mold oscillation drive 11. The control unit 12 causes the drive 11 to oscillate the mold 5 during a casting process with programmed adjustment of the oscillation frequency and stroke. The control unit 12 receives instructions from a computer 14 which is programmed with an oscillation program 20 designed to effect oscillation of the mold 5 in the manner described with reference to FIGS. 1–4. The computer 14 may be programmed with a variety of programs such as the program 20 which are designed, by way of example, for different steel grades, different strand shapes and/or dimensions, different lubricants and different strand withdrawal speeds.

The force required to oscillate the mold 5 is measured continuously throughout a casting process and is indicative of the friction between the mold 5 and the strand. The hydraulic control unit 12 continuously sends a feedback signal 21 representative of such force to a discriminator or comparator 15 where the signal 21, which represents the friction in the mold, is compared with a reference signal 22 representing a reference value of friction. The comparator 15 generates a signal 23 indicative of the difference between the friction in the mold 5 and the reference value of friction. The differential signal 23 is sent to the computer 14 which continuously optimizes the negative strip time interval $t_n$, the ratio of $t_n$ to the duration, $t_c$, of an oscillation cycle, the mold oscillation stroke, the mold oscillation frequency, and so on within predetermined limits. Such optimization minimizes the friction between the mold 5 and the strand.

The friction in the mold 5 can be determined by means other than measurement of the force required to oscillate the mold 5. Thus, it is possible to measure this friction directly at the mold or at the lever arms 6,7 of the mold oscillation mechanism using conventional devices such as accelerometers, piezoelectric cells and/or strain gauges.

The mold 5 can be provided with a known warning device 25 for breakouts. If the warning device 25 senses that a breakout is imminent, the device 25 sends a signal 26 to a controller 18 which is connected to the computer 14. The signal 26 acts via the controller 18 to adjust the strand withdrawal speed and thereby prevent the breakout.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method for the continuous casting of steel, comprising the steps of forming a continuously cast steel strand in a continuous casting mold, said mold defining a casting passage having an inlet end and an outlet end, and the forming step including admitting molten steel into said inlet end and at least partially solidifying said molten steel in said mold; withdrawing said strand from said passage via said outlet end in a first direction; oscillating said mold by alternately moving the latter in said first direction and in a second direction counter to said first direction, the oscillating step being performed in such a manner that displacement of said mold varies cyclically with time in a sawtooth-like fashion; and regulating oscillation of said mold so that, during an oscillation cycle, the speed of said mold exceeds the speed of said strand essentially throughout travel of said mold in said first direction and the travel time of said mold in said first direction approximates 0.1 second, the regulating step further being performed in such a manner that the oscillation frequency increases from a value between about 60 and about 120 cycles per minute to a value between about 120 and about 200 cycles per minute as said strand accelerates in a first range of speeds extending from standstill to a predetermined speed between about 0.8 and about 1.2 meter per minute, and the regulating step also being performed such that the oscillation frequency remains substantially constant while the oscillation stroke increases with strand speed as said strand accelerates from said predetermined speed in a second range of speeds.

2. The method of claim 1, wherein the regulating step comprises increasing the oscillation frequency according to the relationship $f=K\cdot V_c^n$ where f is the oscillation frequency, K is a constant, $V_c$ is the speed of the strand and n is a number less than about 0.5.

3. The method of claim 1, wherein the regulating step comprises maintaining the oscillation stroke substantially constant as the oscillation frequency increases.

4. The method of claim 3, wherein the regulating step comprises maintaining the oscillation stroke at a substantially fixed value between about 2 and about 5 mm as the oscillation frequency increases.

5. The method of claim 1, wherein the regulating step comprises holding the travel time of said mold in said first direction between about $0.1t_c$ and about $0.2t_c$ during an oscillation cycle within said first range where $t_c$ is the duration of an oscillation cycle.

6. The method of claim 1, wherein the regulating step comprises increasing the oscillation stroke in said second range proportionally to strand speed while maintaining the oscillation stroke within the range of about 2 to about 12 mm.

7. The method of claim 1, wherein the regulating step comprises setting the ratio $V_n/V_c$ to a value between about 1.02 and about 1.10 in said second range where $V_n$ is the speed of said mold during travel in said first direction and $V_c$ is the speed of said strand.

8. The method of claim 1, wherein the regulating step comprises holding the travel time of said mold in said first direction between about $0.2t_c$ and $0.33t_c$ during an oscillation cycle within said second range where $t_c$ is the duration of an oscillation cycle.

9. An apparatus for the continuous casting of steel, comprising a continuous casting mold for steel, said mold defining a casting passage having an inlet end for molten steel and an outlet end for a continuously cast steel strand, and said outlet end being spaced from said inlet end in a first direction; a mechanism for oscillating said mold so that the latter alternately moves in said first direction and in a second direction counter to said first direction in a sawtooth-like fashion with time; and means for regulating said mechanism, said regulating means including computer means programmed to effect oscillation of said mold so that, during an oscillation cycle, the speed of said mold exceeds the speed of the strand essentially throughout travel of said mold in said first direction and the travel time of said mold in said first direction approximates 0.1 second, and said computer means further being programmed to increase the oscillation frequency from a value between about 60 and about 120 cycles per minute to a value between about 120 and about 200 cycles per minute as the strand accelerates in a first range of speeds extending from standstill to a predetermined speed between about 0.8 and about 1.2 meter per minute, said computer means also being programmed to maintain the oscillation frequency substantially constant while increasing the oscillation stroke with strand speed as the strand accelerates from said predetermined speed in a second range of speeds, and said regulating means additionally including a comparator for continuously comparing the friction between the strand and said mold with a reference value and continuously transmitting a signal indicative of the difference to said computer means, said computer means being operative to vary the oscillation of said mold in response to said signal so as to minimize friction between the strand and said mold.

10. The apparatus of claim 9, wherein said mechanism includes an hydraulic drive and a pair of short levers for guiding said mold, one of said levers being connected with said drive.

11. A continuous casting method, comprising the steps of forming a continuously cast strand in a continuous casting mold, said mold defining a casting passage having an inlet end and an outlet end, and the forming step including admitting molten material into said inlet end and at least partially solidifying said molten material in said mold; withdrawing said strand from said passage via said outlet end in a first direction; oscillating said mold by alternately moving the latter in said first direction and in a second direction counter to said first direction; and regulating oscillation of said mold in such a manner that the oscillation frequency increases as said strand accelerates in a first range of speeds to a predetermined speed equal to or less than about 1.2 meter per minute, the regulating step further being performed such that the oscillation frequency remains substantially constant while the oscillation stroke increases with strand speed as said strand accelerates from said predetermined speed in a second range of speeds.

12. The method of claim 11, wherein the regulating step comprises increasing the oscillation frequency according to the relationship $f=K \cdot V_c^n$ where f is the oscillation frequency, K is a constant, $V_c$ is the speed of said strand and n is a number less than about 0.5.

13. The method of claim 11, wherein the regulating step comprises maintaining the oscillation stroke substantially constant as the oscillation frequency increases.

14. The method of claim 11, wherein the regulating step comprises holding the travel time of said mold in said first direction between about $0.1t_c$ and $0.2t_c$ during an oscillation cycle within said first range where $t_c$ is the duration of an oscillation cycle.

15. The method of claim 11, wherein the regulating step comprises setting the ratio $V_n/V_c$ to a value between about 1.02 and about 1.10 in said second range where $V_n$ is the speed of said mold during travel in said first direction and $V_c$ is the speed of said strand.

16. The method of claim 11, wherein the regulating step comprises holding the travel time of said mold in said first direction between about $0.2t_c$ and $0.33t_c$ during an oscillation cycle within said second range where $t_c$ is the duration of an oscillation cycle.

17. A continuous casting apparatus, comprising a continuous casting mold defining a casting passage having an inlet end for molten material and an outlet end for a continuously cast strand of the material, said outlet end being spaced from said inlet end in a first direction; a mechanism for oscillating said mold so that the latter alternately moves in said first direction and in a second direction counter to said first direction; and means for regulating said mechanism, said regulating means including computer means programmed to effect oscillation of said mold in such a manner that the oscillation frequency increases as the strand accelerates in a first range of speeds to a predetermined speed equal to or less than about 1.2 meter per minute, and said computer means further being programmed to maintain the oscillation frequency substantially constant while increasing the oscillation stroke with strand speed as the strand accelerates from the predetermined speed in a second range of speeds.

18. The apparatus of claim 17, wherein said computer means is programmed to maintain the oscillation stroke substantially constant as the oscillation frequency increases and to increase the oscillation frequency according to the relationship $f=K \cdot V_c^n$ where f is the oscillation frequency, K is a constant, $V_c$ is the speed of the strand and n is a number less than about 0.5.

19. The apparatus of claim 17, wherein said computer means is programmed to hold the travel time of said mold in said first direction between about $0.1t_c$ and about $0.2t_c$ during an oscillation cycle within said first range and between about $0.2t_c$ and about $0.33t_c$ during an oscillation cycle within said second range where $t_c$ is the duration of an oscillation cycle.

20. The apparatus of claim 17, wherein said computer means is programmed to set the ratio $V_n/V_c$ to a value between about 1.02 and about 1.10 in said second range where $V_n$ is the speed of said mold during travel in said first direction and $V_c$ is the speed of the strand.

* * * * *